US009764546B2

(12) United States Patent
Hayashi et al.

(10) Patent No.: US 9,764,546 B2
(45) Date of Patent: Sep. 19, 2017

(54) LIQUID DISCHARGE APPARATUS

(71) Applicant: BROTHER KOGYO KABUSHIKI KAISHA, Nagoya-shi, Aichi-ken (JP)

(72) Inventors: Masayoshi Hayashi, Nagoya (JP); Shuhei Hiwada, Toyoake (JP); Takahiko Watari, Nagoya (JP); Jie Chen, Tokyo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/281,984

(22) Filed: Sep. 30, 2016

(65) Prior Publication Data

US 2017/0087828 A1 Mar. 30, 2017

(30) Foreign Application Priority Data

Sep. 30, 2015 (JP) ..... 2015-192740

(51) Int. Cl.
*B41J 2/045* (2006.01)

(52) U.S. Cl.
CPC ..... *B41J 2/04541* (2013.01); *B41J 2/0455* (2013.01); *B41J 2/04523* (2013.01); *B41J 2/04581* (2013.01); *B41J 2/04588* (2013.01)

(58) Field of Classification Search
CPC .. B41J 2/04541; B41J 2/0455; B41J 2/04523; B41J 2/04581; B41J 2/04588
See application file for complete search history.

(56) References Cited

U.S. PATENT DOCUMENTS

| | | | | |
|---|---|---|---|---|
| 7,234,788 | B2 * | 6/2007 | Gardner | B41J 2/04508 347/10 |
| 2005/0083359 | A1 | 4/2005 | Tamura | |
| 2008/0018686 | A1 * | 1/2008 | Oshima | B41J 2/04541 347/11 |

FOREIGN PATENT DOCUMENTS

| | | | |
|---|---|---|---|
| JP | H07-137249 | A | 5/1995 |
| JP | 2001-301158 | A | 10/2001 |
| JP | 2002-002948 | A | 1/2002 |
| JP | 2002-321362 | A | 11/2002 |
| JP | 2005-088582 | A | 4/2005 |
| JP | 2011-156666 | A | 8/2011 |

* cited by examiner

*Primary Examiner* — Julian Huffman
(74) *Attorney, Agent, or Firm* — Scully, Scott, Murphy & Presser, PC

(57) ABSTRACT

There is provided a liquid discharge apparatus, including: a drive element configured to apply discharge energy to the liquid to discharge the liquid; signal generators configured to generate a plurality of types of drive signals having mutually different waveforms to drive the drive element; and drive switches electrically located between the signal generators and the drive element to correspond to the plurality of types of drive signals respectively. The drive switches include a first drive switch and a second drive switch which are different in ON-resistance.

15 Claims, 11 Drawing Sheets

Fig. 6A 〈SMALL DROPLET〉
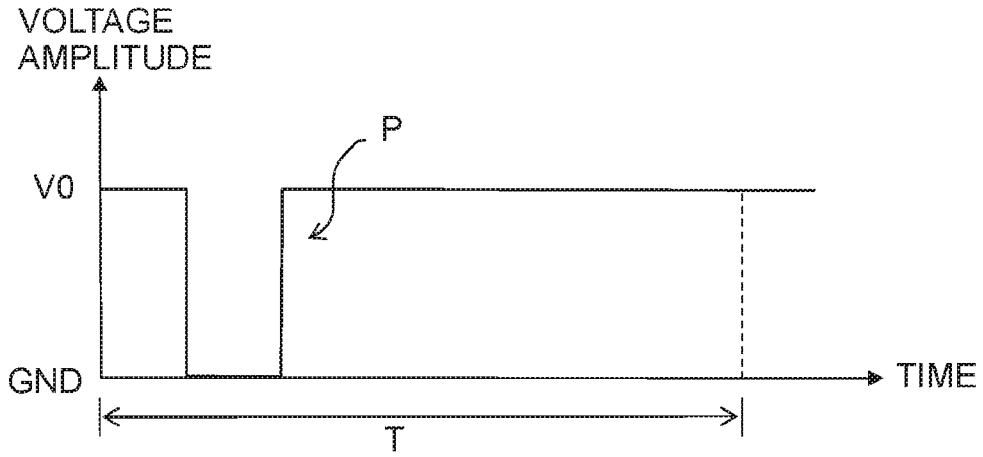
Fig. 6B 〈MEDIUM DROPLET〉
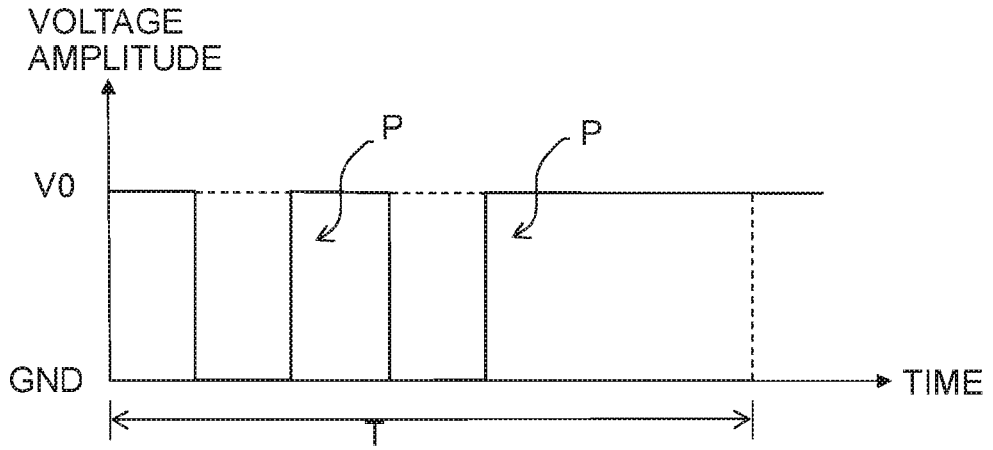
Fig. 6C 〈LARGE DROPLET〉
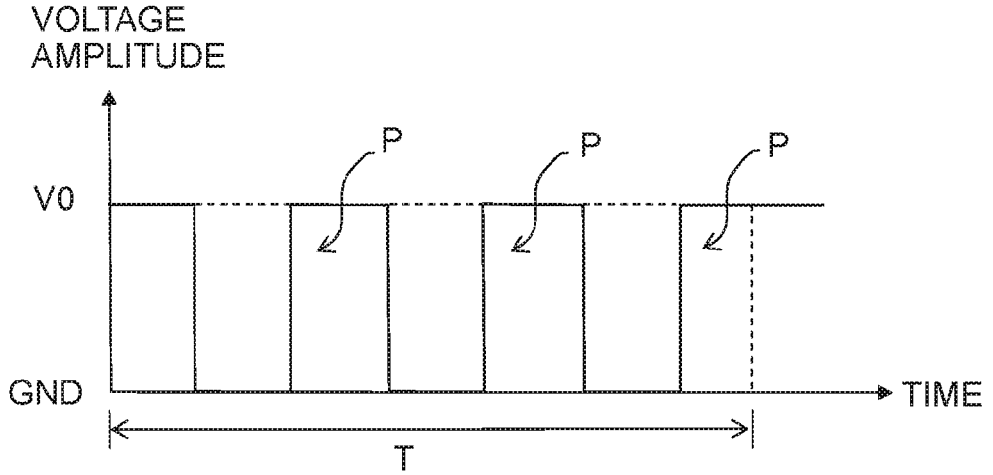

Fig. 7A 〈SMALL DROPLET〉
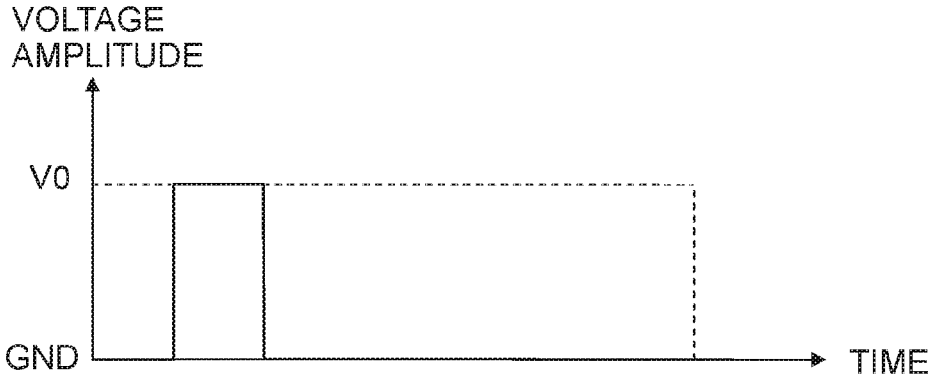
Fig. 7B 〈MEDIUM DROPLET〉
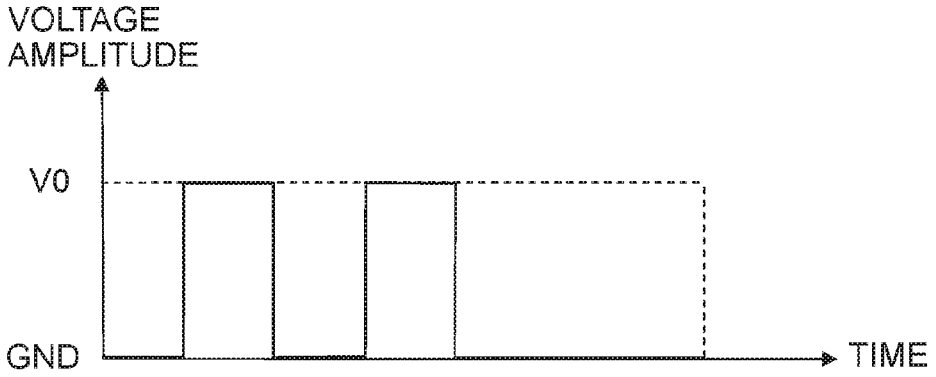
Fig. 7C 〈LARGE DROPLET〉
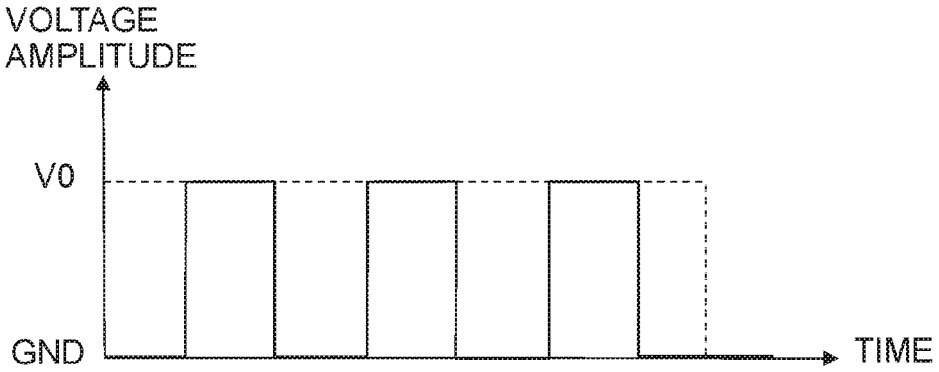

Fig. 8A 〈SMALL DROPLET〉
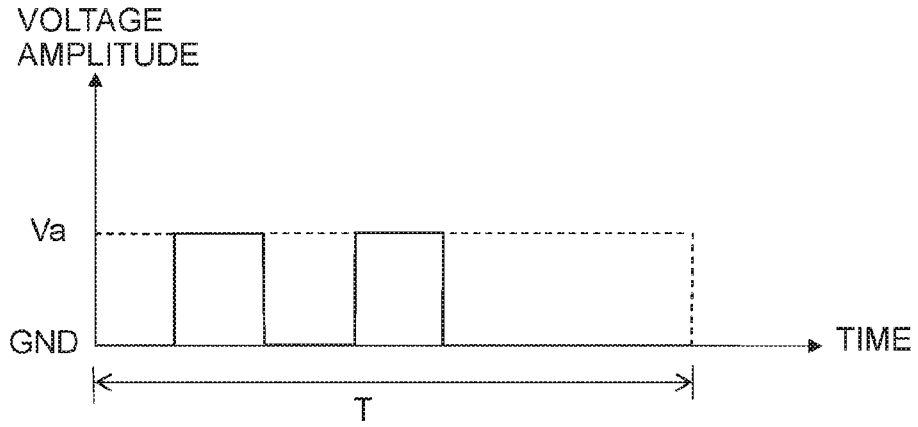
Fig. 8B 〈MEDIUM DROPLET〉
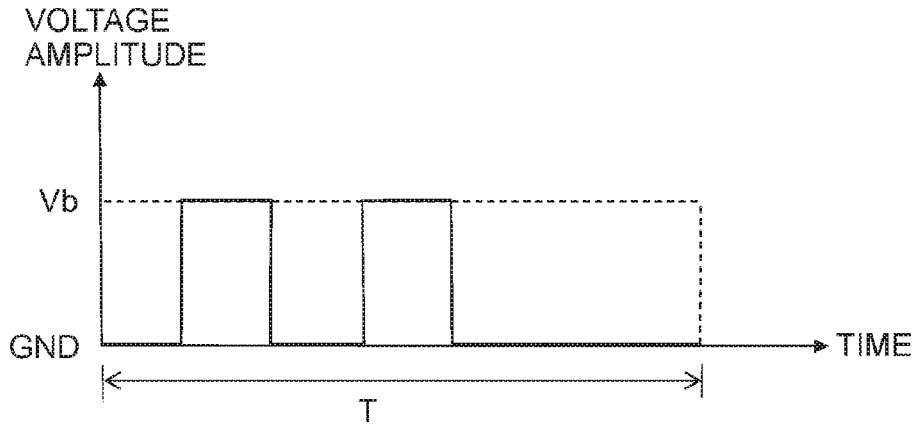
Fig. 8C 〈LARGE DROPLET〉
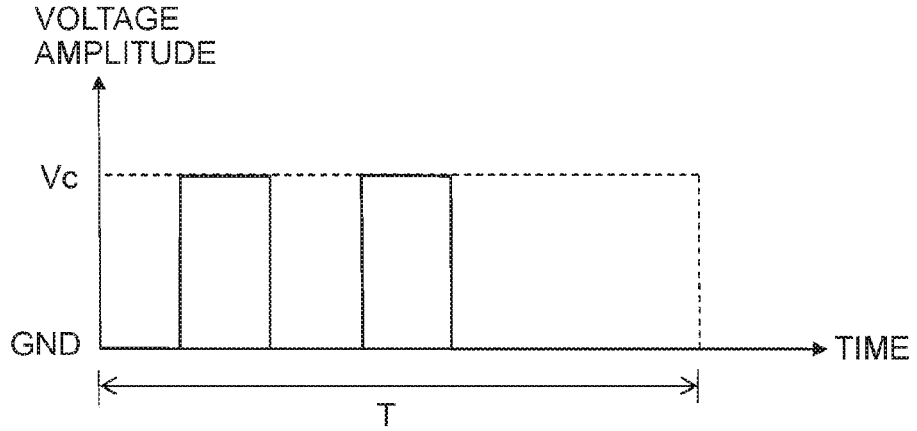

Fig. 9A 〈SMALL DROPLET〉
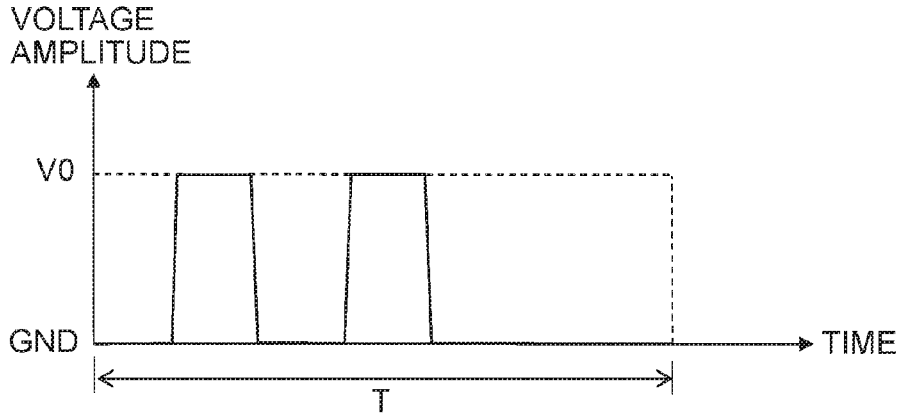
Fig. 9B 〈MEDIUM DROPLET〉
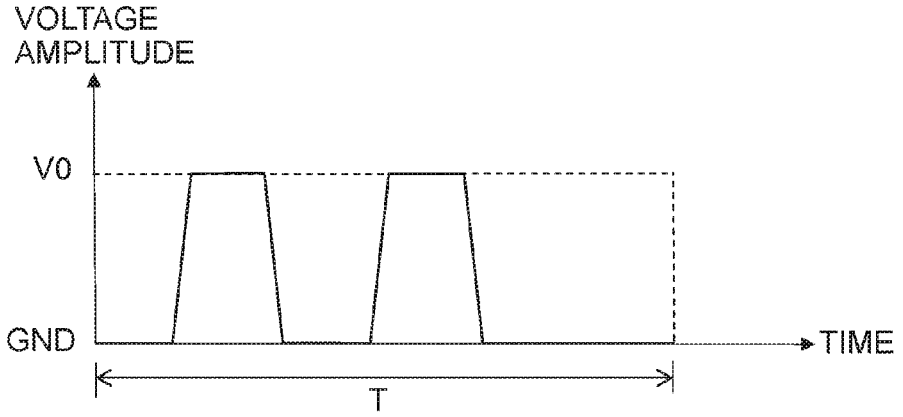
Fig. 9C 〈LARGE DROPLET〉
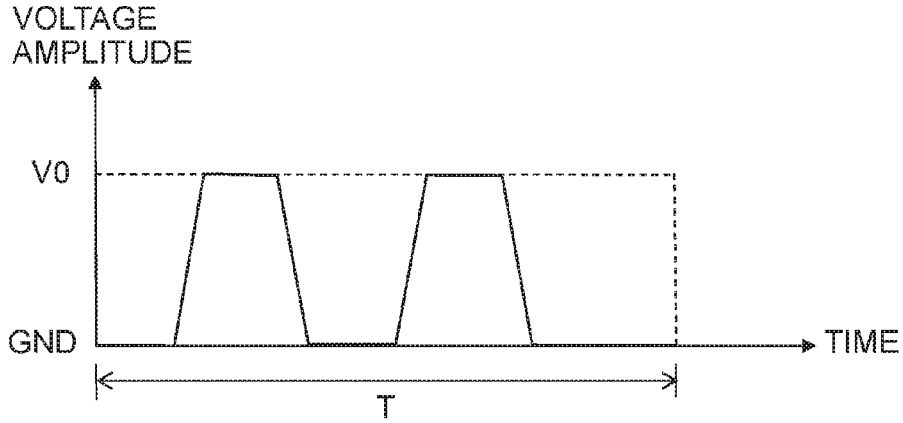

Fig. 11A 〈DISCHARGE DRIVE SIGNAL〉
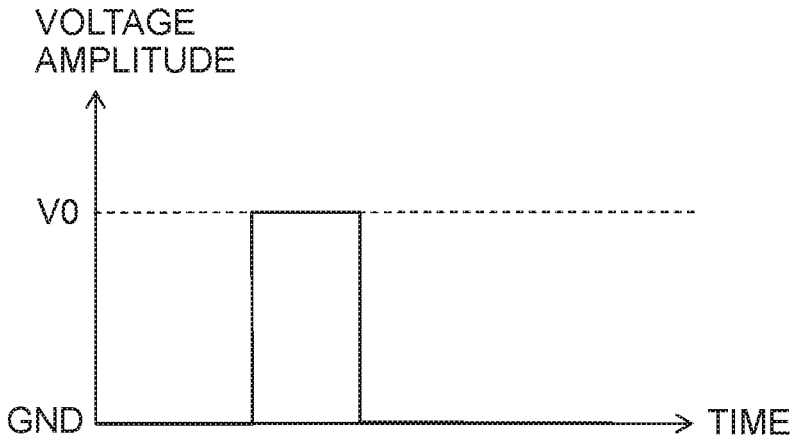
Fig. 11B 〈MENISCUS VIBRATION SIGNAL〉
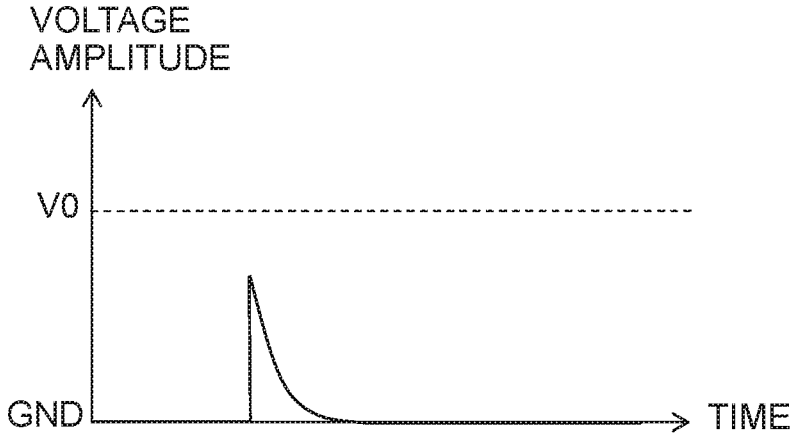

LIQUID DISCHARGE APPARATUS

CROSS REFERENCE TO RELATED APPLICATION

The present application claims priority from Japanese Patent Application No. 2015-192740 filed on Sep. 30, 2015, the disclosure of which is incorporated herein by reference in its entirety.

BACKGROUND

Field of the Invention

The present invention relates to a liquid discharge apparatus.

Description of the Related Art

As a liquid discharge apparatus, there is conventionally known an ink-jet printer which jets an ink from nozzles onto a paper sheet to perform print of a letter, an image, and the like.

The known ink-jet printer includes a print head and a printer controller. The print head is provided with nozzles and piezoelectric vibrators each configured to jet the ink from one of the nozzles.

There is known a printer discharging ink droplets (liquid droplets) having different sizes (different ink amounts) from each nozzle of the plurality of nozzles to thereby change the diameter of each dot formed on the paper sheet, namely, capable of performing a so-called liquid droplet gradation. The printer controller includes a drive signal generating part generating a drive signal for driving each piezoelectric vibrator. The drive signal generating part generates two types of drive signals having mutually different drive pulses, and supplies them to the print head. Further, the printer controller develops a print data sent or transmitted to the ink-jet printer from outside, generates the gradation data for each of the nozzles, and transmits the gradation data to the print head.

The print head includes two analogue switches corresponding to the two types of drive signals, respectively, for each of the piezoelectric vibrators. The two analogue switches corresponding to each one of the piezoelectric vibrators perform switchover between the two types of drive signals to determine as to which one of the two types of drive pulses is to be outputted to each of the piezoelectric vibrators, depending on the gradation data sent from the printer controller. This allows a signal having a waveform corresponding to a desired size of the liquid droplet to be outputted to each of the piezoelectric vibrators.

SUMMARY

A switching circuit formed of a transistor typically has electric resistance (ON-resistance) which inhibits or impedes the flow of electric current in a state that the switch is turned on. In the above-described printer, the heat generation in each of the switches is greater, as the ON-resistance in each of the switches constructing the switching circuit is greater. The great ON-resistance in each of the switches may cause a blunt waveform of the switch depending on the waveform of the drive signal, which affects the operation of the element, and consequently, the amount and/or speed of the liquid droplet jetted from the nozzle.

In order to make the ON-resistance in the switch small, the transistor constructing the switch needs to have a large size. In view of the miniaturization and the cost, it is not enough just to reduce the ON-resistance in the transistor.

An object of the present teaching is to provide a liquid discharge apparatus in which a switch selecting a drive signal to be outputted to a drive element is prevented from having heat generation and a blunt waveform without the increase in size of the switch.

According to an aspect of the present teaching, there is provided a liquid discharge apparatus configured to discharge liquid, comprising:

a drive element configured to apply energy to the liquid to discharge the liquid;

a plurality of signal generators each configured to generate a plurality of types of drive signals having mutually different waveforms to drive the drive element; and a plurality of drive switches each electrically located between one of the signal generators and the drive element to correspond to the plurality of types of drive signals respectively, wherein the drive switches include a first drive switch and a second drive switch which are different in ON-resistance.

BRIEF DESCRIPTION OF THE DRAWINGS

FIGS. 6A to 6C are waveform diagrams of drive signals for a small droplet, a medium droplet, and a large droplet, respectively.

FIGS. 7A to 7C are waveform diagrams of drive signals for a small droplet, a medium droplet, and a large droplet, respectively, according to a modified embodiment.

FIGS. 8A to 8C are waveform diagrams of drive signals for a small droplet, a medium droplet, and a large droplet, respectively, according to another modified embodiment.

FIGS. 9A to 9C are waveform diagrams of drive signals for a small droplet, a medium droplet, and a large droplet, respectively, according to still another modified embodiment.

FIGS. 11A and 11B are waveform diagrams of a discharge drive signal and a meniscus vibration signal, respectively, according to the embodiment of FIG. 10.

DESCRIPTION OF THE EMBODIMENTS

Figure 1:
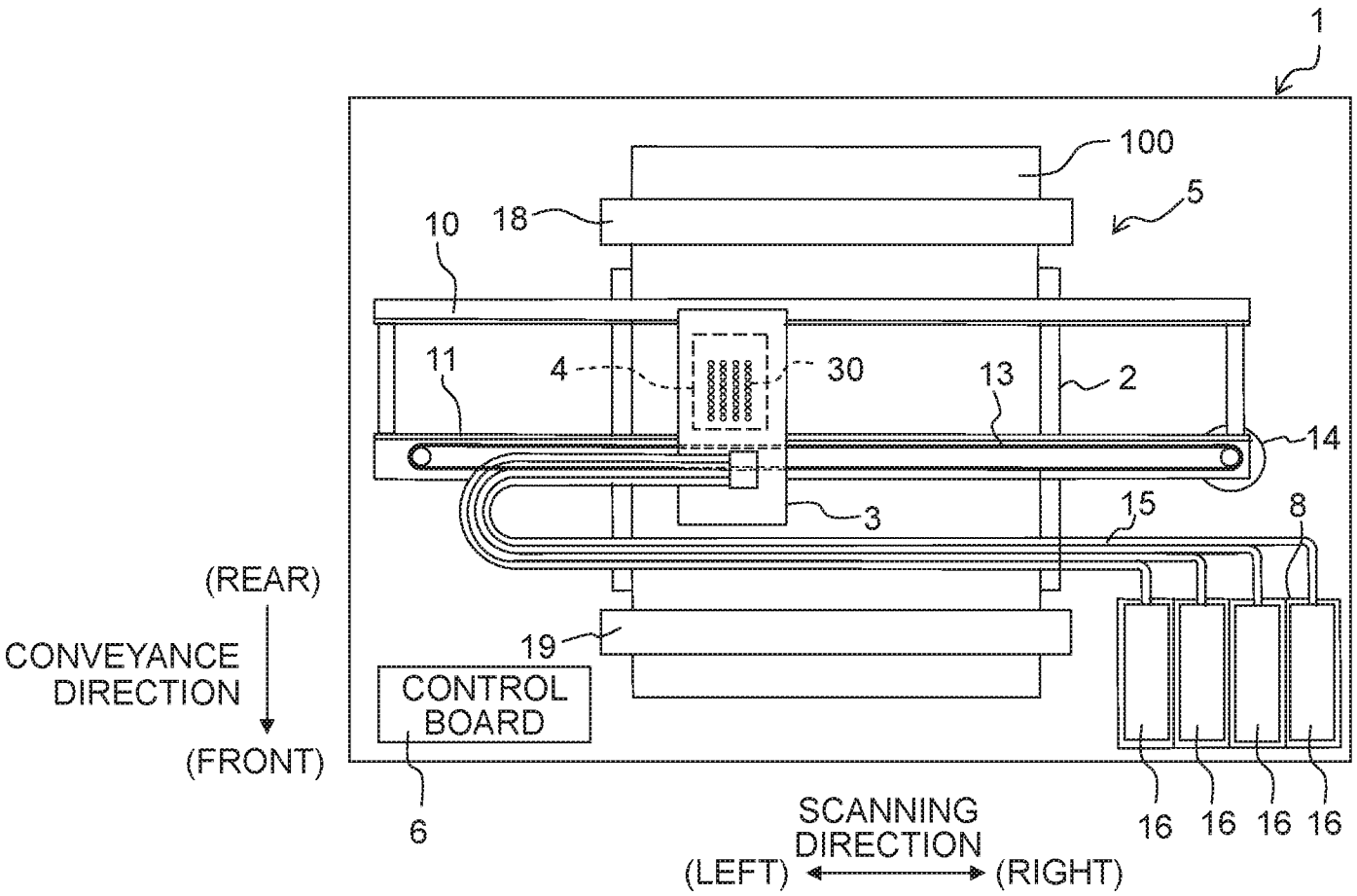
FIG. 1 is a schematic plan view of an ink-jet printer 1 according to an embodiment of the present teaching.

Subsequently, an explanation will be made about an embodiment of the present teaching. The scanning direction depicted in FIG. 1 is defined as the left-right direction of a printer 1. In FIG. 1, the side at which a cartridge holder 8 is disposed is the right side; the side at which the cartridge holder 8 is not disposed is the left side; the upstream side in a conveyance direction is defined as the rear side of the printer 1; and the downstream side in the conveyance direction is defined as the front side of the printer 1. The direction perpendicular to the scanning direction and the conveyance direction (the direction perpendicular to a paper surface of FIG. 1) is defined as the up-down direction of the printer 1. The front side of the paper surface at which a carriage 3 is disposed is defined as the upper side, and the rear side of the paper surface at which a platen 2 is disposed is defined as the lower side.

<Overall Structure of Printer>

As depicted in FIG. 1, the ink-jet printer 1 includes the platen 2, the carriage 3, an ink-jet head 4, a conveyance part 5, and a control board 6.

A recording sheet 100 as a recording medium is placed on the upper surface of the platen 2. The carriage 3 is configured to reciprocate in the scanning direction, within an area facing the platen 2, along two guide rails 10 and 11. An endless belt 13 is connected to the carriage 3. The endless belt 13 is driven by a carriage drive motor 14 to move the carriage 3 reciprocatingly in the scanning direction.

The ink-jet head 4, which is carried on the carriage 3, reciprocates in the scanning direction together with the carriage 3. The ink-jet head 4 is connected, via tubes 15, to the cartridge holder 8 to which ink cartridges 16 of inks of four colors (black, yellow, cyan, and magenta) are installed. The ink-jet head 4 includes nozzles 30 formed in its lower surface (the paper surface on the rear side of FIG. 1). Each of the inks supplied from one of the ink cartridges 16 is discharged from each nozzle 30 to the recording sheet 100 on the platen 2. The detailed structure of the ink-jet head 4 will be described later.

As depicted in FIG. 1, the conveyance part 5 includes two conveyance rollers 18 and 19 disposed to sandwich the platen 2 in a front-rear direction. The two conveyance rollers 18 and 19 are driven in synchronization with each other by an unillustrated motor to convey the recording sheet 100 placed in the platen 2 in the conveyance direction orthogonal to the scanning direction.

The control board 6 includes a Read Only Memory (ROM), a Random Access Memory (RAM), an Application Specific Integrated Circuit (ASIC) including various control circuits, and the like. The ASIC in the control board 6 performs various kinds of processing regarding the operation of the printer 1, such as print processing on the recording sheet 100. In the print processing, for example, the ASIC controls the ink-jet head 4, the carriage drive motor 14, the motors driving the conveyance rollers 18 and 19, and the like, based on a print command inputted to the printer 1 from an external device such as a personal computer, to print an image or the like on the recording sheet 100. In particular, the ASIC alternately performs ink discharge operation in which the ink-jet head 4 discharges the ink while moving in the scanning direction together with the carriage 3 and conveyance operation in which the conveyance rollers 18 and 19 convey the recording sheet 100 in the conveyance direction by a predetermined amount.

<Detailed Structure of Ink-Jet Head>

Figure 2:
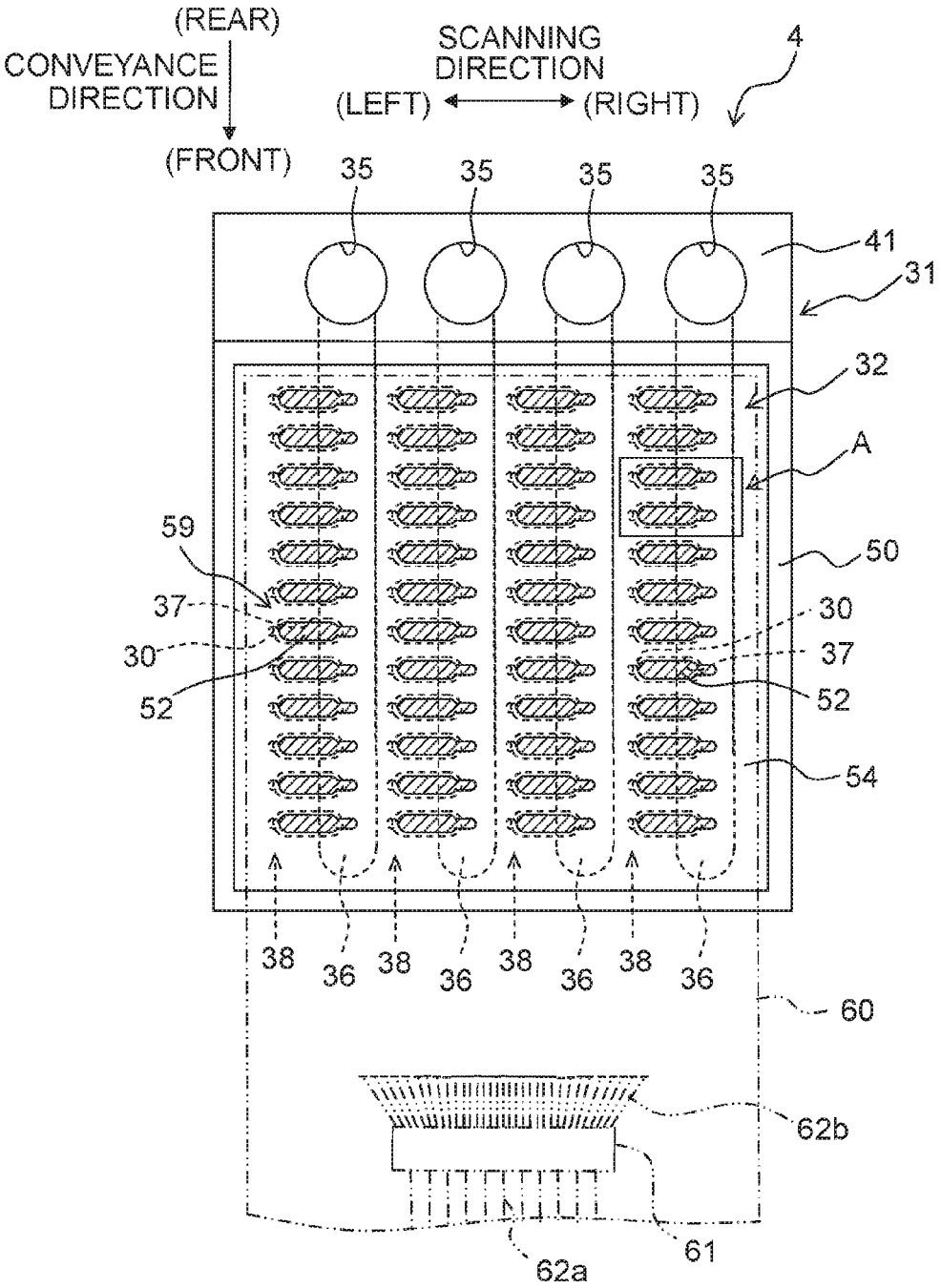
FIG. 2 is a top view of an ink-jet head 4.
Figure 3:
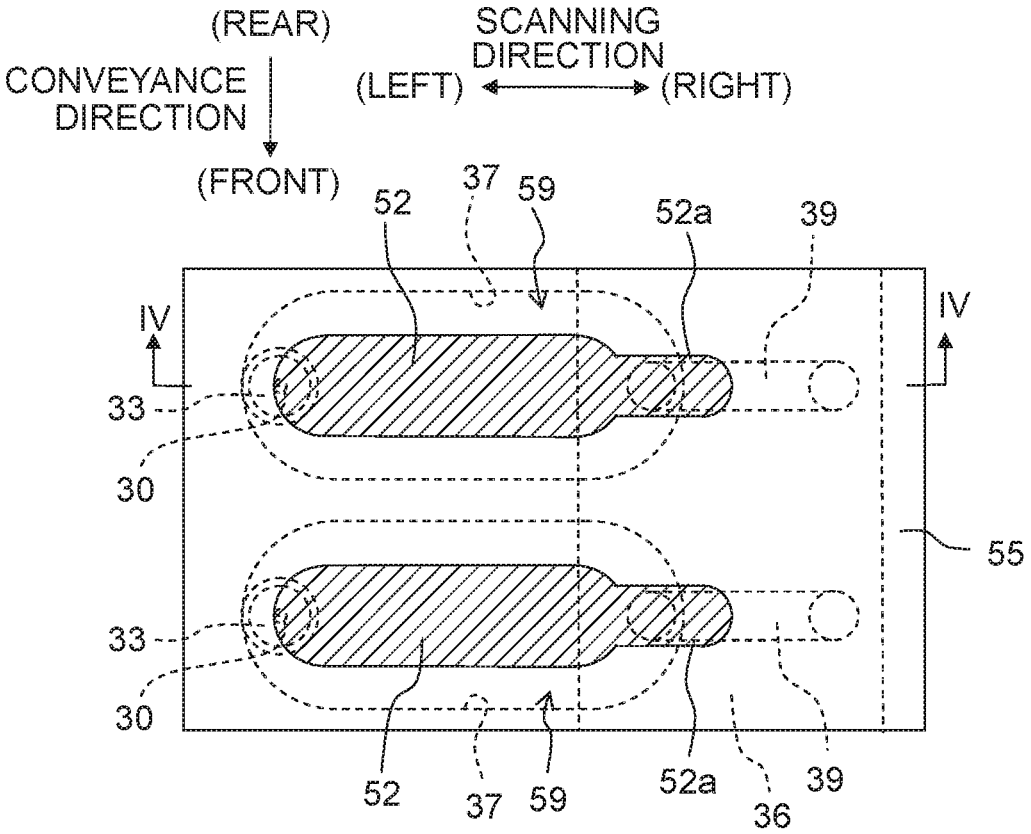
FIG. 3 is an enlarged view depicting the portion A of FIG. 2.
Figure 4:
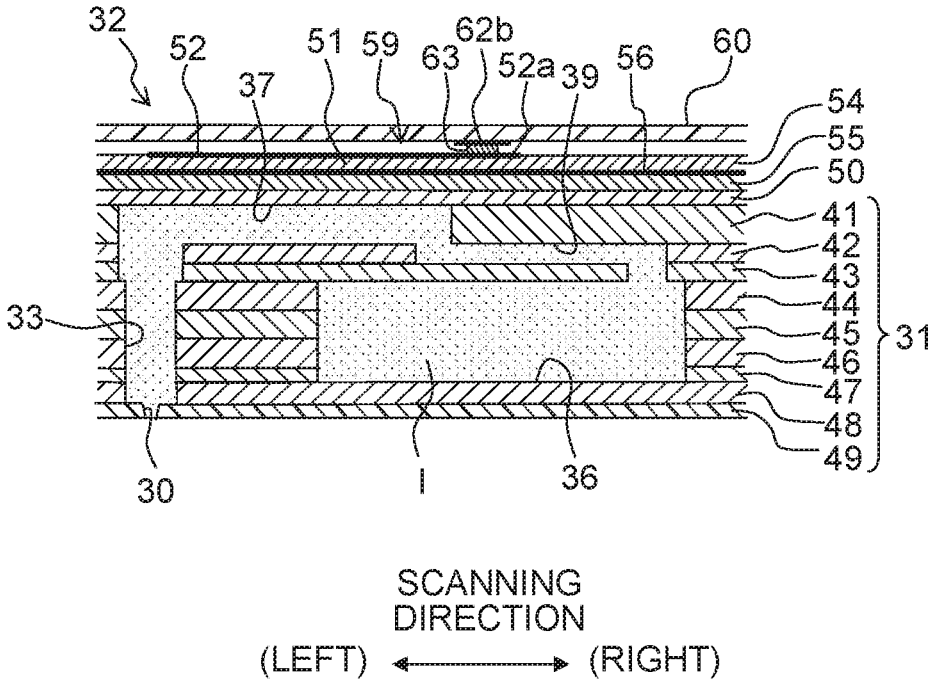
FIG. 4 is a cross-sectional view taken along the line IV-IV of FIG. 3.

Subsequently, an explanation will be made about the ink-jet head 4. As depicted in FIGS. 2 to 4, the ink-jet head 4 includes a channel unit 31, a piezoelectric actuator 32, a Chip On Film (COF) 60, and the like. In FIG. 2, the COF 60 disposed to cover the piezoelectric actuator 32 is depicted by the alternate long and two short dashes line, for easy understanding of the structure of the ink-jet head 4. In FIG. 3, the illustration of the COF 60 is omitted. FIG. 4 depicts a state in which an ink channel formed in the channel unit 31 is filled with an ink (indicated by the reference sign "I").

<Channel Unit>

As depicted in FIG. 4, the channel unit 31 includes plates 41 to 49 stacked on top of each other. The stacked plates 41 to 49 are joined to each other by adhesive. The lowermost plate of the plates 41 to 49 is a nozzle plate 49 which is made of a synthetic resin such as polyimide. The nozzle plate 49 includes the nozzles 30. As depicted in FIG. 2, the nozzles 30 are aligned in the conveyance direction to form four nozzle groups 38 disposed side by side in the scanning direction. The inks of four colors (black, yellow, cyan, and magenta) are discharged from the four nozzle groups 38, respectively.

The plates 41 to 48, except for the nozzle plate 49, constituting the channel unit 31 are plates made of a metal material such as stainless steel. The ink channels communicating with the nozzles 30 are formed in the plates 41 to 48 to include, for example, manifolds 36 and pressure chambers 37.

As depicted in FIG. 2, the uppermost plate 41 constituting the upper surface of the channel unit 31 includes four ink supply holes 35 which are disposed in the scanning direction. The inks of four colors (black, yellow, cyan, and magenta) are supplied from the four ink cartridges 16 (see FIG. 1) in the cartridge holder 8 to the four ink supply holes 35, respectively. Four manifolds 36 extending in the conveyance direction are formed in the fourth to seventh plates 44 to 47 from the uppermost plate 41. The four ink supply holes 35 are connected to the four manifolds 36 through communication holes (not depicted) formed in the plates 42 and 43.

The uppermost plate 41 of the channel unit 31 includes pressure chambers 37 corresponding to the nozzles 30, respectively. Each of the pressure chambers 37 has a substantially elliptical shape elongated in the scanning direction in plan view. The pressure chambers 37 are disposed in four rows corresponding to the four manifolds 36. The pressure chambers 37 are covered with a vibration plate 50 of the piezoelectric actuator 32. As depicted in FIGS. 3 and 4, the second uppermost plate 42 includes throttle channels 39 connecting the manifolds 36 and the pressure chambers 37. A total of seven plates 42 to 48 positioned between the uppermost plate 41 and the nozzle plate 49 include communication channels 33 connecting the pressure chambers 37 and the nozzles 30.

Namely, each of the four manifolds 36 communicates with the nozzles 30 belonging to the corresponding one of the nozzle groups 38, via individual channels constructed of the throttle channels 39, the pressure chambers 37, and the communication channels 33.

<Piezoelectric Actuator>

The piezoelectric actuator 32 is disposed on the upper surface of the channel unit 31. The piezoelectric actuator 32 applies discharge energy to the ink in each pressure chamber 37 so as to discharge the ink from the nozzle 30. As depicted in FIGS. 2 to 4, the piezoelectric actuator 32 includes the vibration plate 50, piezoelectric layers 54 and 55, individual electrodes 52, and a common electrode 56.

The vibration plate 50 is joined to the upper surface of the channel unit 31 to cover the pressure chambers 37. The vibration plate 50 is, for example, made of a metal material such as stainless steel.

Each of the two piezoelectric layers 54 and 55 is made of a piezoelectric material. Examples of materials usable for the piezoelectric layers 54 and 55 include lead zirconate titanate which is a mixed crystal of lead titanate and lead zirconate, a lead-free piezoelectric material such as barium titanate, and a niobium-based piezoelectric material. The piezoelectric layers 54 and 55 are joined to the upper surface of the vibration plate 50 in a state of being stacked onto each other.

The individual electrodes 52, which are disposed on the upper surface of the upper piezoelectric layer 54, are aligned in the conveyance direction to correspond to the pressure chambers 37, respectively. Each of the individual electrodes 52 has a substantially elliptical shape which is elongated in the scanning direction and is smaller to some extent than the pressure chamber 37 in plan view. Each of the individual electrodes 52 is disposed to face a center portion of the corresponding one of the pressure chambers 37. A connection terminal 52*a* is provided at one end of each individual electrode 52 in its longitudinal direction. The connection terminal 52*a*, which is disposed on the upper surface of the piezoelectric layer 54, extends in the scanning direction from the individual electrode 52 to an area not facing the corresponding pressure chamber 37.

The common electrode 56 is disposed between the two piezoelectric layers 54 and 55 so that the common electrode 56 entirely faces the piezoelectric layers 54, 55. The common electrode 56 faces each of the individual electrodes 52 with the upper piezoelectric layer 54 sandwiched therebetween.

In the above configuration, one piezoelectric element 59 is constructed of one individual electrode 52, an electrode portion, of the common electrode 56, facing one pressure chamber 37, and portions, of the piezoelectric layers 54 and 55, facing one pressure chamber 37. A portion, of each piezoelectric element 59, sandwiched between the individual electrode 52 on the upper piezoelectric layer 54 and the common electrode 56 is referred to as an active portion 51 in the following description. The active portion 51 of each piezoelectric element 59 is polarized downward in its thickness direction, namely, in the direction from the individual electrode 52 to the common electrode 56.

<COF>

As depicted in FIGS. 2 and 4, a first end of the COF 60 is disposed above the piezoelectric actuator 32. The COF 60 mounts an IC chip 61. The COF 60 includes input wiring lines 62*a* and output wiring lines 62*b* which are connected to the IC chip 61.

As depicted in FIG. 4, a first end of each of the output wiring lines 62*b* is joined to the connection terminal 52*a* of the corresponding one of the individual electrodes 52 with a bump 63. This allows the IC chip 61 to be electrically connected to the individual electrodes 52 of the piezoelectric elements 59 of the piezoelectric actuator 32. Although illustration is omitted, a second end of the COF 60 on the side opposite to the piezoelectric actuator 32 is connected to the control board 6. This allows the IC chip 61 to be electrically connected to the control board 6 via the input wiring lines 62*a* of the COF 60. As will be described later, the IC chip 61 supplies a drive signal, which has a predetermined pulse waveform, to the individual electrode 52 of each of the piezoelectric elements 59, according to a signal sent from the control board 6. The common electrode 56 is electrically connected to a ground line (not depicted) provided in the COF 61. This allows the common electrode 56 to be always kept in a ground potential.

An explanation will be made about the action of the piezoelectric element 59 when the ink is discharged from the nozzle 30. When the drive signal is supplied from the IC chip 61 to the individual electrode 52 of the piezoelectric element 59, the difference in electrical potential between the individual electrode 52 and the common electrode 56 occurs and an electric field parallel to the thickness direction of the piezoelectric element 59 acts on the active portion 51. Since the direction of the electric field is parallel to the polarization direction of the active portion 51, the active portion 51 expands in its thickness direction and contracts in its planer direction. The contraction deformation of the active portion 51 bends the vibration film 50, so that the vibration film 50 becomes convex toward the pressure chamber 37. This reduces the volume of the pressure chamber 37 to generate the pressure wave in the ink in the pressure chamber 37. The ink is discharged from the nozzle 30 communicating with the pressure chamber 37, accordingly.

<Details of Drive of Piezoelectric Actuator>

Subsequently, an explanation will be made about the electrical configuration driving the piezoelectric actuator 32 in detail.

Figure 5:
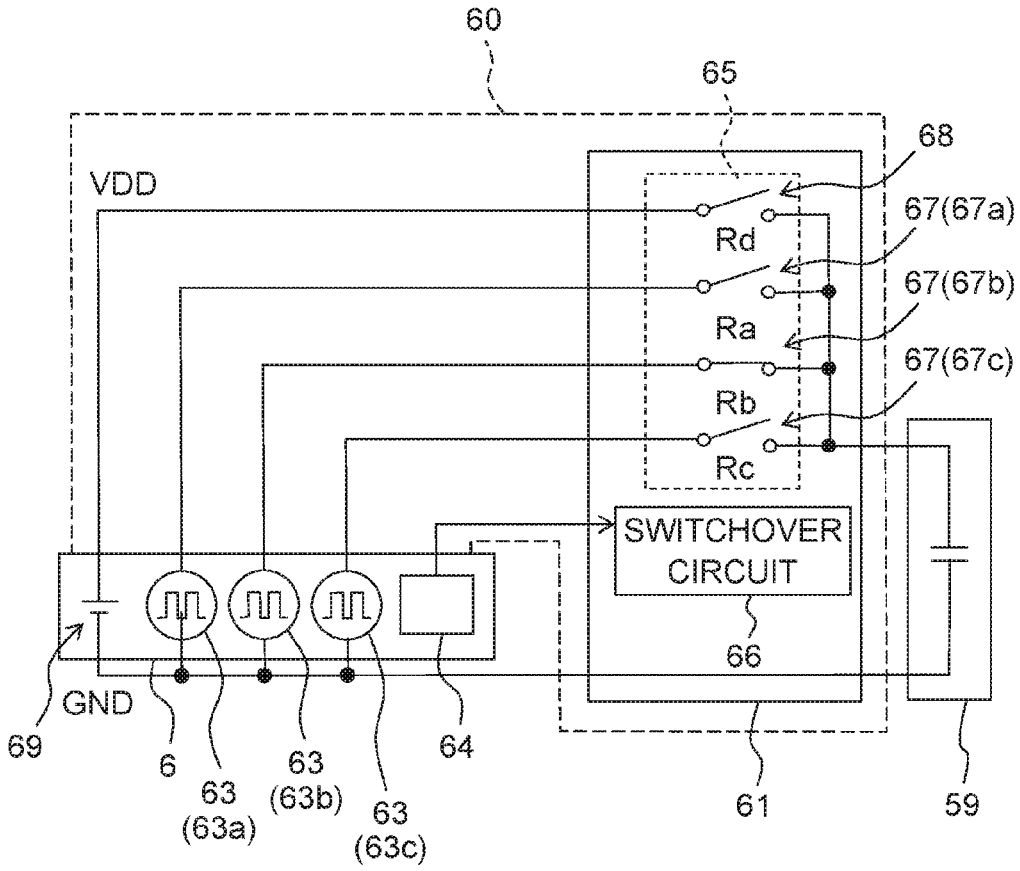
FIG. 5 is a schematic circuit diagram of a control board 6 and an IC chip 61.

The configuration of the control board 6 will be explained first. As depicted in FIG. 5, the control board 6 includes three signal generation parts 63 (63*a*, 63*b*, and 63*c*) and a selection data generation part 64.

The three signal generation parts 63*a*, 63*b*, and 63*c* generate three types of drive signals (FIGS. 6A, 6B, and 6C) having mutually different waveforms to drive each piezoelectric element 59. The three types of drive signals cause liquid droplets different in size (small droplet, medium droplet, and large droplet), in other words, liquid droplets different in amount, to be discharged from one nozzle 30. Thus, the printer 1 of this embodiment is a printer which can perform liquid droplet gradation control in which the gradation is changed according to the size of the liquid droplet. The signal generation part 63*a* generates the drive signal for the small droplet depicted in FIG. 6A, the signal generation part 63*b* generates the drive signal for the medium droplet depicted in FIG. 6B, and the signal generation part 63*c* generates the drive signal for the large droplet depicted in FIG. 6C.

As depicted in FIGS. 6A to 6C, each of the three types of drive signals is a pulse signal having a pulse P. More specifically, each of the drive signals is a pulse signal of which reference voltage is high voltage (V0). The high voltage drops to low voltage only when the pulse P is applied. The high voltage level (V0) of each drive signal may be any voltage value and the low voltage level of each drive signal may be any voltage value. For example, the high voltage level V0 is power-supply voltage (VDD) and the low voltage level is ground (GND) in this embodiment.

The three types of drive signals have mutually different numbers of pulses P included in a period (print period T) during which one dot is formed on the recording sheet 100. The greater energy is applied to the ink in each pressure chamber 37 to discharge a greater liquid droplet from the nozzle 30, as the number of pulses P in the print period T is greater. The drive signal for the small droplet depicted in FIG. 6A includes one pulse P, the drive signal for the medium droplet depicted in FIG. 6B includes two pulses P, and the drive signal for the large droplet depicted in FIG. 6C includes three pulses P.

The selection data generation part 64 generates, based on a print image data inputted from outside to the printer 1, a selection data for selecting, from among the three types of drive signals, a drive signal to be supplied to each piezoelectric element 59. The selection data is a data of a plurality of bits. For example, when one of the four forms including the small droplet, the medium droplet, the large droplet, and non-ejection is selected for one nozzle 30, the selection data of two bits is allocated as follows: (1,1) allocated to the large droplet; (1,0) allocated to the medium droplet; (0,1) allocated to the small droplet; and (0,0) allocated to the non-ejection.

Subsequently, an explanation will be made about the IC chip 61. As depicted in FIG. 5, the IC chip 61 includes a switch circuit 65 and a switchover circuit 66 which performs switchover of the switch circuit 65.

The switch circuit 65 includes three drive switches 67 (67*a*, 67*b*, and 67*c*) and a constant-voltage switch 68. The three drive switches 67 (67*a*, 67*b*, and 67*c*) are electrically located between the three signal generation parts 63 (63*a*, 63*b*, and 63*c*) of the control board 6 and the piezoelectric element 59. That is, one end of the signal generation parts 63*a* is electrically connected to one end of the drive switches 67*a*, and the other end of the drive switches 67*a* is electrically connected to the piezoelectric element 59. Similarly, one end of the signal generation parts 63*b* is electrically connected to one end of the drive switches 67*b*, the other end of the drive switches 67*b* is electrically connected to the piezoelectric element 59, one end of the signal generation parts 63*c* is electrically connected to one end of the drive switches 67*c*, and the other end of the drive switches 67*c* is electrically connected to the piezoelectric element 59. The constant-voltage switch 68, which outputs a constant power-supply voltage (VDD), is electrically located between a power source as a constant-voltage source and the piezoelectric element 59. That is, one end of the power source is electrically connected to one end of the constant-voltage switch 68, and the other end of the constant-voltage switch 68 is electrically connected to the piezoelectric element 59. FIG. 5 only depicts one switch circuit 65 corresponding to one piezoelectric element 59, but actually, the IC chip 61 includes multiple switch circuits 65 corresponding to multiple piezoelectric elements 59, respectively.

The switchover circuit 66 performs the switchover of each of the three drive switches 67 based on the selection data which is generated, for each piezoelectric element 59, in the selection data generation part 64 of the control board 6. For example, when the (1, 0) selection data corresponding to the medium droplet is sent to a piezoelectric element 59, the switchover circuit 66 turns the drive switch 67*b* on and turns the remaining drive switches 67*a* and 67*c* off, as depicted in FIG. 5. Further, the switchover circuit 66 turns the constant-voltage switch 68 off. The drive signal which is generated by the signal generation part 63*b* and is depicted in FIG. 6B is supplied to the piezoelectric element 59, accordingly.

When the (0,0) selection data corresponding to the non-ejection is sent to a piezoelectric element 59, the switchover circuit 66 turns all of the three drive switches 67 off. This makes it impossible to supply the drive signal from each of the three signal generation parts 63 to the piezoelectric element 59.

When one of the drive switches 67*a* to 67*c* is turned on in the state that all of the three drives switches 67*a* to 67*c* are turned off, attention needs to be paid to the following point. Namely, the voltage applied to the piezoelectric element 59 is preferably maintained at the reference voltage (high voltage V0) of each drive signal with all of the drive switches 67*a* to 67*c* turned off, but actually, the voltage applied to the piezoelectric element 59 gradually decreases because of a slight leak current in the piezoelectric element 59. When the drive signal is supplied in a state that the voltage applied to the piezoelectric element 59 is very low, the voltage suddenly changes at the moment the reference voltage (high voltage V0) of the drive signal is applied. This changes the ink pressure in the pressure chamber 37 greatly and instantaneously, thereby causing fine or minute liquid droplet(s) (i.e., mist(s)) to be discharged from the nozzle 30 before the application of the pulse P.

Thus, the switchover circuit 66 is configured to turn the constant-voltage switch 68 on every time the switchover circuit 66 turns all of the three drive switches 67*a* to 67*c* off. This allows the constant power-source voltage (VDD) to be always applied to the piezoelectric element 59 even during a period in which no ink is discharged from the nozzle 30. Thus, the voltage applied to piezoelectric element 59 will not vary greatly at the time of application of the next drive signal.

In this embodiment, the signal generation parts 63 generating the high voltage drive signal are provided in the control board 6. Meanwhile, there have been known a configuration in which a COF mounts a driver IC generating a drive signal, that is, a configuration in which a driver part is provided on an ink-jet head side (for example, Japanese Patent Application Laid open No. 2011-156666). In this configuration, high heat is generated in the driver IC which generates the drive signal. Further, a down-sized ink-jet head and high integration of the piezoelectric element increase the required heat dissipation amount per unit area of the ink-jet head, thereby leading to the lack or shortage of the heat dissipation area. Thus, some kind of measure is necessary, such as that another heat dissipating mechanism with a large heat dissipation area is separately provided on the ink-jet head side. Such a large heat dissipating mechanism, however, is not preferable, because it prevents the ink-jet head from being downsized.

In this embodiment, the three signal generation parts 63 are provided in the control board 6. Namely, the IC chip 61 of the COF 60 only includes the switch circuit 65 switching the three types of drive signals. Thus, the configuration of this embodiment allows the heat generation amount on the ink-jet head 4 side to be smaller than that of the above conventional configuration. Although the configuration of this embodiment makes the heat generation amount in the control board 6 larger than that of the above conventional configuration, the heat dissipating mechanism with the large heat dissipation area can be provided in the control board 6 relatively easily, unlike the ink-jet head 4 having many restrictions because of the demand of downsizing.

Each of the drive switches 67 in the switch circuit 65 is typically constructed of a transistor. The switch constructed of the transistor has electric resistance (also referred to as "ON-resistance") which inhibits or impedes the flow of electric current with the switch turned on. The heat generation in the drive switch 67 increases as the ON-resistance in the drive switch 67 increases. The great ON-resistance in the drive switch 67 causes the waveform of the switch 67 to be blunt, affecting the operation of the piezoelectric element 59, and consequently the amount and/or speed of liquid droplet to be discharged from the nozzle 30.

Thus, it is preferred that the ON-resistance in the drive switch 67 be small. However, making the ON-resistance small increases the size of transistor constituting the switch 67. In view of the size and cost of the IC chip 61, it is preferred that only a switch which is susceptible to the ON-resistance have small ON-resistance.

In this embodiment, in view of effectively reducing the heat generation in the IC Chip 61, the three drive switches 67 have different levels of ON-resistance.

As described above, the three types of drive signals corresponding to the three drive switches 67*a*, 67*b*, and 67*c* are different in the number of pulses included in the print period T. A larger number of pulses increases the number of times the piezoelectric element 59 is driven, thus increasing the heat generation in the drive switch 67. In view of this, in this embodiment, the ON-resistance in each of the three drive switches 67 is smaller, as the number of pulses of the corresponding one of the drive signals is larger. Namely, assuming that the drive switch 67*a* has ON-resistance Ra, the drive switch 67*b* has ON-resistance Rb, and the drive switch 67*c* has ON-resistance Rc, Ra (small droplet)>Rb (medium droplet)>Rc (large droplet) is satisfied. For example, Ra=300Ω, Rb=200Ω, and Rc=100Ω.

If the constant voltage switch 68 connected to the power source 69 has small ON-resistance, electric current may flow in an excessive amount. Thus, it is preferred that the ON-resistance in the constant voltage switch 68 be relatively large. Although great ON-resistance in the drive switch 67 causes the waveform of the drive signal to be blunt, the constant voltage switch 68 does not suffer from such a problem. On the contrary, making the ON-resistance in the constant voltage switch 68 greater reduces the size of the transistor constituting the switch 68. Thus, in this embodiment, the constant voltage switch 68 has ON-resistance Rd which is greater than the ON-resistance Ra, Rb, or Rc in each of all the drives switches 67. The ON-resistance Rd in the constant voltage switch 68 may be considerably greater than the ON-resistance in each of all the three drive switches 67, for example, Rd=100 kΩ.

In the above embodiment, the ink-jet printer 1 corresponds to a "liquid discharge apparatus" of the present teaching; the ink-jet head 4 corresponds to a "liquid discharge head" of the present teaching; the piezoelectric element 59 corresponds to a "drive element" of the present teaching; when the drive signal for the large droplet depicted in FIG. 6C is defined as a "first drive signal" of the present teaching, the drive signal for the small droplet depicted in FIG. 6A and the drive signal for the medium droplet depicted in Fig, 6B, those of which have smaller numbers of pulses than that of the first drive signal, are each defined as a "second drive signal" of the present teaching; the selection data generation part 64 of the control board 6 and the switchover circuit 66 of the IC chip 61 which performs the switchover of each of the drive switches 67 according to the selection data constitute a "switchover part" of the present teaching.

Subsequently, an explanation will be made about modified embodiments in which various modifications are made to the above embodiment. Note that, any parts or components constructed in the same manner as those of the above embodiment are designated with same reference numerals, and description or illustration thereof is omitted as appropriate.

Although all of the drive switches 67 have different levels of ON-resistance in the above embodiment, the present teaching is not limited thereto. For example, two drive switches 67 of the three drive switches 67 may have the same ON-resistance, and the remaining one drive switch 67 may have ON-resistance different from that of the two drive switches 67.

The multiple drive signals are not limited to those having mutually different numbers of pulses as described above. For example, the following modification can be made.

As depicted in FIG. 7, each of the drive signals may have a waveform in which its reference voltage is the GND and the voltage applied to the piezoelectric element 59 rises only when the pulse is applied. This eliminates the need for applying the constant voltage to the piezoelectric element 59 during the non-ejection state, and thus the constant voltage switch 68 depicted in FIG. 6 can be omitted.

As depicted in FIG. 8, the three types of drive signals may have mutually different amplitudes. In FIG. 8, although the three types of drive signals have the same number of pulses (two pulses) in the print period T, the three types of drive signals have mutually different amplitudes of the pulses. The greater pulse amplitude causes greater energy to be applied to the ink, resulting in a larger liquid droplet from the nozzle 30. Namely, the relation of amplitudes of the three types of drive signals is as follows: "the amplitude for the small droplet Va"<"the amplitude for the medium droplet Vb"<"the amplitude for the large droplet Vc".

In that case, the heat generation in the drive switch 67 is greater, as the amplitude of the drive signal is greater. Thus, it is preferred that the ON-resistance in each of the three drive switches 67*a,* 67*b,* and 67*c* be smaller, as the amplitude of the corresponding one of the drive signals is greater. Namely, "the switch resistance for the small droplet Ra">"the switch resistance for the medium droplet Rb">"the switch resistance for the large droplet Rc" is satisfied. Assuming that the drive signal for the large droplet depicted in FIG. 8C is defined as a "third drive signal" of the present teaching, the drive signal for the small droplet depicted in FIG. 8A and the drive signal for the medium droplet depicted in FIG. 8B, those of which have amplitudes smaller than that of the third drive signal, are defined as a "fourth drive signal" of the present teaching.

As depicted in FIG. 9, the three types of drive signals may have mutually different gradients in voltage change. In FIG. 9, although the three types of drive signals have the same number of pulses (two pulses) in the print period T, the three types of drive signals have different degrees of steepness in voltage change at pulse rise timing and pulse fall timing. The different voltage gradients at the pulse rise timing and pulse fall timing vary the magnitude of energy to be applied to the ink, thereby resulting in various sizes of liquid droplets to be discharged from the nozzle 30. Whether the voltage gradient makes the liquid droplet large or small depends on the waveform or the like. For example, in FIG. 9, the greater gradient (the greater degree of steepness) makes the size of liquid droplet smaller. Namely, "the voltage gradient for the small droplet (steep)">"the voltage gradient for the medium droplet">"the voltage gradient for the large droplet (gentle)" is satisfied.

When the drive signal has a great gradient in voltage change, the ON-resistance in the drive switch 67 may be great. In that case, the drive signal can not follow the steep voltage change, causing a blunt signal waveform before or after the drive switch 67. Thus, the ON-resistance in each of the three drive switches 67*a,* 67*b,* and 67*c* can be smaller as the voltage gradient of the corresponding one of the drive signals is greater. Namely, "the switch resistance for the large droplet Rc">"the switch resistance for the medium droplet Rb">"the switch resistance for the small droplet Ra" is satisfied. Assuming that the drive signal for the small droplet depicted in FIG. 9A is defined as a "fifth drive signal" of the present teaching, the drive signal for the medium droplet depicted in FIG. 9B and the drive signal for the large droplet depicted in FIG. 9C, those of which have voltage gradients smaller than that of the fifth drive signal, are each defined as a "sixth drive signal" of the present teaching.

The present description illustratively describes three embodiments including: the embodiment in which the drive signals have different numbers of pulses to provide different levels of ON-resistance in the drive switches (FIG. 6); the embodiment in which the drive signals have different amplitudes to provide different levels of ON-resistance in the drive switches (FIG. 8); and the embodiment in which the drive signals have different voltage gradients to provide different levels of ON-resistance in the drive switches (FIG. 9). Since the contribution to heat generation increases in the following order: "the number of pulses">"amplitude">"voltage gradient", the ON-resistance in each drive switch is preferably smaller in that order. For example, when an A signal with one pulse of which amplitude is great is compared with a B signal with two pulses of which amplitude is half the amplitude of the A signal, the B signal has a total heat generation amount larger than that of the A signal. Thus, the ON-resistance in the drive switch corresponding to the B signal is made to be smaller than the ON-resistance in the drive switch corresponding to the A signal.

When no ink is discharged from a nozzle 30 for a long time at the time of print, the ink in the nozzle 30 dries to increase its viscosity. This may cause discharge failure when the viscous ink is discharged next time. To avoid this problem, there is a known technology in which the ink in the nozzle 30 which has not been used for a long time is subjected to meniscus vibration, thereby stirring or agitating the ink in the nozzle 30 to prevent the increase in viscosity of the ink. Namely, the energy smaller than the case in which the ink is discharged is applied to the ink in the pressure chamber 36, thereby vibrating the meniscus without discharge of the ink.

Figure 10:
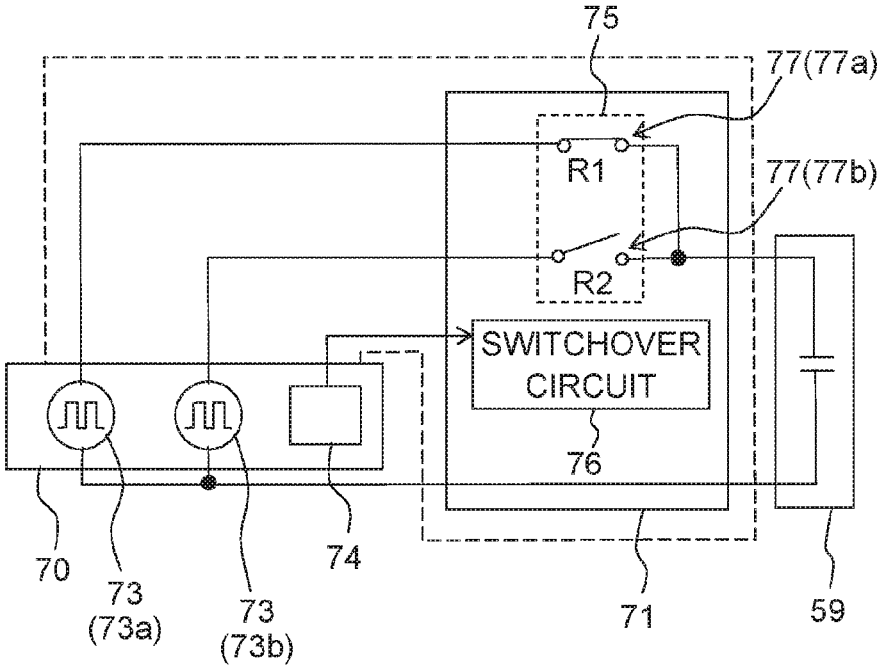
FIG. 10 is a schematic circuit diagram of a control board 70 and an IC chip 71 according to yet another modified embodiment.

As depicted in FIG. 10, a control board 70 includes two signal generation parts 73*a*, 73*b* and a selection data generation part 74. Each of the two signal generation parts 73*a* and 73*b* generates a drive signal for driving the piezoelectric element 59. The signal generation part 73*a* generates a discharge drive signal for discharging the ink from the nozzle 30. The signal generation part 73*b* generates a meniscus vibration signal for vibrating the ink meniscus in the nozzle 30. An IC chip 71 includes a switch circuit 75 and a switchover circuit 76. The switch circuit 75 includes a drive switch 77*a* corresponding to the discharge drive signal and a drive switch 77*b* corresponding to a meniscus drive signal.

The waveform of the meniscus drive signal is not particularly limited, provided that the energy to be applied to the ink is smaller than that of the discharge drive signal so as to discharge no ink from the nozzle 30. For example, as depicted in FIG. 11B, the meniscus vibration signal may be a signal with a waveform raising the voltage instantaneously, unlike the pulse waveform of the discharge drive signal depicted in FIG. 11A. Or, the meniscus vibration signal may be a signal with a pulse waveform of which voltage amplitude is smaller than that of the discharge drive signal.

The meniscus vibration is typically performed for all of the nozzles 30 from which no ink is discharged at the time of print. Namely, if the ink is discharged from a small number of nozzles 30, the meniscus vibration is performed for a large number of remaining nozzles 30 collectively. This increases a total number of times the piezoelectric element is driven, thereby making a total amount of heat generation in the switch circuit 75 considerably larger. Thus, it is desired that the heat generation in each drive switch 77 be reduced as much as possible. Further, since the meniscus vibration discharges no ink from the nozzle 30, the heat generated by the meniscus vibration can not be dissipated through the ink discharge. This will cause the ink-jet head to be filled with the heat. Thus, the ON-resistance R2 in the drive switch 77*b* corresponding to the meniscus drive signal can be smaller than the ON-resistance R1 in the drive switch 77*a* corresponding to the discharge drive signal. For example, R1=1 kΩ and R2=200Ω.

In the above embodiment, the drive element discharging the ink from the nozzle 30 is the piezoelectric element 59. The present teaching, however, is not limited thereto, and it may be any other drive element than the piezoelectric element. For example, the drive element may be one with a heating element which heats the ink to generate film boiling. Namely, in a switch circuit in which a drive signal is selectively supplied, from among a plurality of types of drive signals, to one heating element, a plurality of drive switches corresponding to the plurality of types of drive signals may have different levels of ON-resistance.

In the above embodiments, the present teaching is applied to the ink-jet head which discharges the ink on the recording sheet to print an image or the like thereon. The present teaching, however, may be applied to a liquid discharge apparatus which is used in various ways of use other than the print of the image or the like. The present teaching can be also applied, for example, to a liquid discharge apparatus which discharges a conductive liquid onto a substrate to form a conductive pattern on the surface of the substrate.

What is claimed is:

1. A liquid discharge apparatus configured to discharge liquid, comprising:

a drive element configured to apply energy to the liquid to discharge the liquid;

a plurality of signal generators each configured to generate a plurality of types of drive signals having mutually different waveforms to drive the drive element; and a plurality of drive switches each electrically located between one of the signal generators and the drive element to correspond to the plurality of types of drive signals respectively, wherein the drive switches include a first drive switch and a second drive switch which are different in ON-resistance.

2. The liquid discharge apparatus according to claim 1, wherein the first drive switch corresponds to a first drive signal included in the plurality of types of drive signals, the second drive switch corresponds to a second drive signal included in the plurality of types of drive signals and having the number of pulses in a certain period of time which is smaller than that of the first drive signal, and the ON-resistance in the first drive switch is smaller than the ON-resistance in the second drive switch.

3. The liquid discharge apparatus according to claim 2, wherein the plurality of types of drive signals have mutually different numbers of pulses, and the ON-resistance in each of the drive switches is smaller, as the number of pulses of the drive signal corresponding to one of the drive switches is greater.

4. The liquid discharge apparatus according to claim 1, wherein the drive switches include a third drive switch corresponding to a third drive signal included in the plurality of types of drive signals and a fourth drive switch corresponding to a fourth drive signal included in the plurality of types of drive signals and having an amplitude smaller than that of the third drive signal, and the ON-resistance in the third drive switch is smaller than the ON-resistance in the fourth drive switch.

5. The liquid discharge apparatus according to claim 4, wherein the plurality of types of drive signals have mutually different amplitudes, and the ON-resistance in each of the drive switches is smaller, as the amplitude of the drive signal corresponding to one of the drive switches is greater.

6. The liquid discharge apparatus according to claim 1, wherein the drive switches include a fifth drive switch corresponding to a fifth drive signal included in the plurality of types of drive signals and a sixth drive switch corresponding to a sixth drive signal included in the plurality of types of drive signals and having a gradient in voltage change which is smaller than that of the fifth drive signal, and the ON-resistance in the fifth drive switch is smaller than the ON-resistance in the sixth drive switch.

7. The liquid discharge apparatus according to claim 6, wherein the plurality of types of drive signals have mutually different gradients in voltage change, and the ON-resistance in each of the drive switches is smaller, as the gradient in voltage change of the drive signal corresponding to one of the drive switches is greater.

8. The liquid discharge apparatus according to claim 1, wherein the plurality of types of drive signals include a discharge drive signal by which the liquid is discharged from the nozzle and a meniscus vibration signal having energy to be applied to the liquid in the nozzle which is smaller than that of the discharge drive signal and by which a meniscus of the liquid in the nozzle is vibrated without discharge of the liquid from the nozzle, the drive switches include a seventh drive switch corresponding to the meniscus vibration signal and an eighth drive switch corresponding to the discharge drive signal, and the ON-resistance in the seventh drive switch is smaller than the ON-resistance in the eighth drive switch.

9. The liquid discharge apparatus according to claim 8, wherein an amplitude of the meniscus vibration signal is smaller than an amplitude of the discharge drive signal.

10. The liquid discharge apparatus according to claim 8, wherein a pulse width of the meniscus vibration signal is smaller than a pulse width of the discharge drive signal.

11. The liquid discharge apparatus according to claim 1, wherein the drive element is a piezoelectric element including a piezoelectric layer and two kinds of electrodes disposed to sandwich the piezoelectric layer, the liquid discharge apparatus further comprises:

a constant-voltage source configured to output constant voltage to the piezoelectric element;

a constant-voltage switch electrically located between the constant-voltage source and the piezoelectric element; and a switchover part configured to perform switchover of each of the drive switches and switchover of the constant-voltage switch, wherein the switchover part is configured to turn on the constant-voltage switch in a case that the switchover part turns off all of the drive switches.

12. The liquid discharge apparatus according to claim 11, wherein the ON-resistance in the constant voltage switch is greater than the ON-resistance in each of all the drive switches.

13. The liquid discharge apparatus according to claim 1, further comprising a control board and a COF, wherein the signal generating parts are mounted on the control board, and the drive switches are mounted on the COF.

14. A driving circuit electrically connected to a drive element and a plurality of signal generators to drive the drive element, each of the plurality of signal generator being configured to generate a plurality of types of drive signals having mutually different waveforms, the driving circuit comprising:

a plurality of drive switches each electrically located between one of the signal generators and the drive element to correspond to the plurality of types of drive signals respectively, wherein the drive switches include a first drive switch and a second drive switch which are different in ON-resistance.

15. A liquid discharge head configured to discharge liquid and electrically connected to a plurality of signal generators each of which is configured to generate a plurality of types of drive signals having mutually different waveforms, the liquid discharge head comprising:

a drive element configured to apply energy to the liquid to discharge the liquid; and a driving circuit configured to drive the drive element, including:

a plurality of drive switches each electrically located between one of the signal generators and the drive element to correspond to the plurality of types of drive signals respectively, wherein the drive switches include a first drive switch and a second drive switch which are different in ON-resistance.

* * * * *